United States Patent [19]

Mangone

[11] Patent Number: 4,887,535

[45] Date of Patent: Dec. 19, 1989

[54] RAIL-HIGHWAY SEMI-TRAILERS

[75] Inventor: Angelo Mangone, Matera, Italy

[73] Assignee: Ferrosud S.p.A., Matera, Italy

[21] Appl. No.: 174,397

[22] Filed: Mar. 28, 1988

[30] Foreign Application Priority Data

Jan. 20, 1988 [IT] Italy ..... 2102 A/88

[51] Int. Cl.[4] ..... B61D 17/20

[52] U.S. Cl. ..... 105/3; 105/4.2

[58] Field of Search ..... 105/3, 4.2, 199.1, 199.4, 105/199.5, 4.1, 453

[56] References Cited

U.S. PATENT DOCUMENTS

| | | | |
|---|---|---|---|
| 2,170,095 | 8/1939 | Ronk | 105/4.2 |
| 3,230,899 | 1/1966 | Johnson | 105/3 |
| 3,521,569 | 7/1970 | Muotka et al. | 105/4.2 |
| 4,311,244 | 1/1982 | Hindin et al. | 213/86 |
| 4,641,587 | 2/1987 | Dalliard | 105/3 |
| 4,690,067 | 9/1987 | Kuker et al. | 105/3 |
| 4,697,526 | 10/1987 | Vigliani | 105/4.2 |

FOREIGN PATENT DOCUMENTS

| | | | |
|---|---|---|---|
| 1186096 | 1/1965 | Fed. Rep. of Germany | 105/4.2 |
| 2124A86 | 10/1976 | Italy . | |

OTHER PUBLICATIONS

Railway Gazette International, Feb. 1981, vol. 137, pp. 115–118.

*Primary Examiner*—Sherman D. Basinger
*Assistant Examiner*—Stephen P. Avila
*Attorney, Agent, or Firm*—Fleit, Jacobson, Cohn, Price, Holman & Stern

[57] ABSTRACT

Improvements with the present invention is concerned relate in particular to special bimodal semi-trailers adapted to travel on both rails and roads, wherewith the rail carriage and the highway carriage as well are removable. The invention may be applied if the highway carriage is non-removable. The invention may be applied if the highway carriage is non-removable, or with other types of bimodal semi-trailers.

20 Claims, 8 Drawing Sheets

FIG. 1A
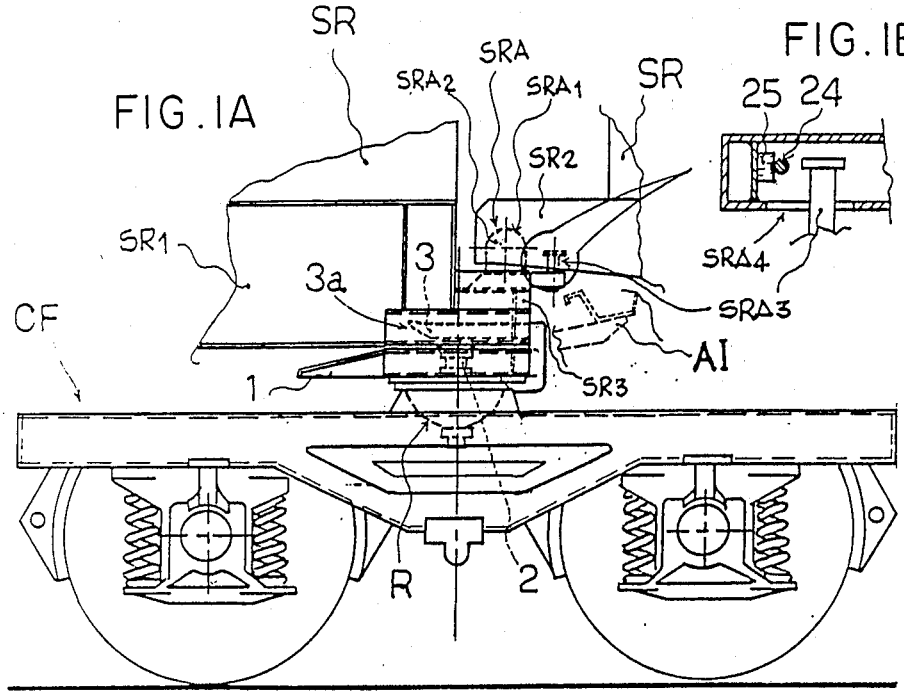
FIG. 1B
FIG. 2A
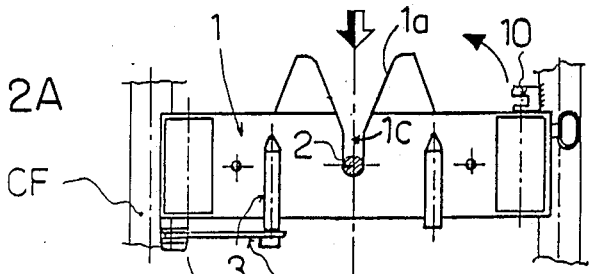
FIG. 2B
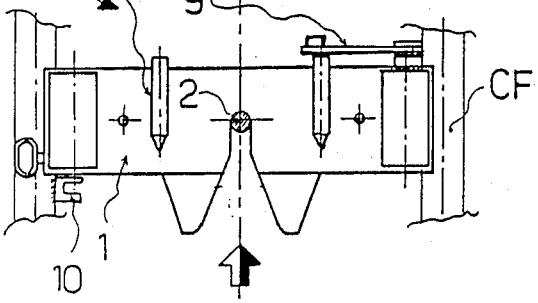

CF
1
1g
1h
3
6
7
9
9a
9b
10
R1
R2
W
Z
J

SRA/3
12
SR3
11e
12a
16
1b
1d
2
11
AI
17
11f
11d
11c
11b
11a
12b

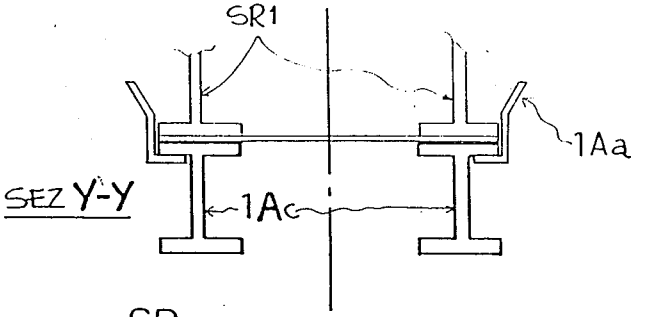
FIG. 12
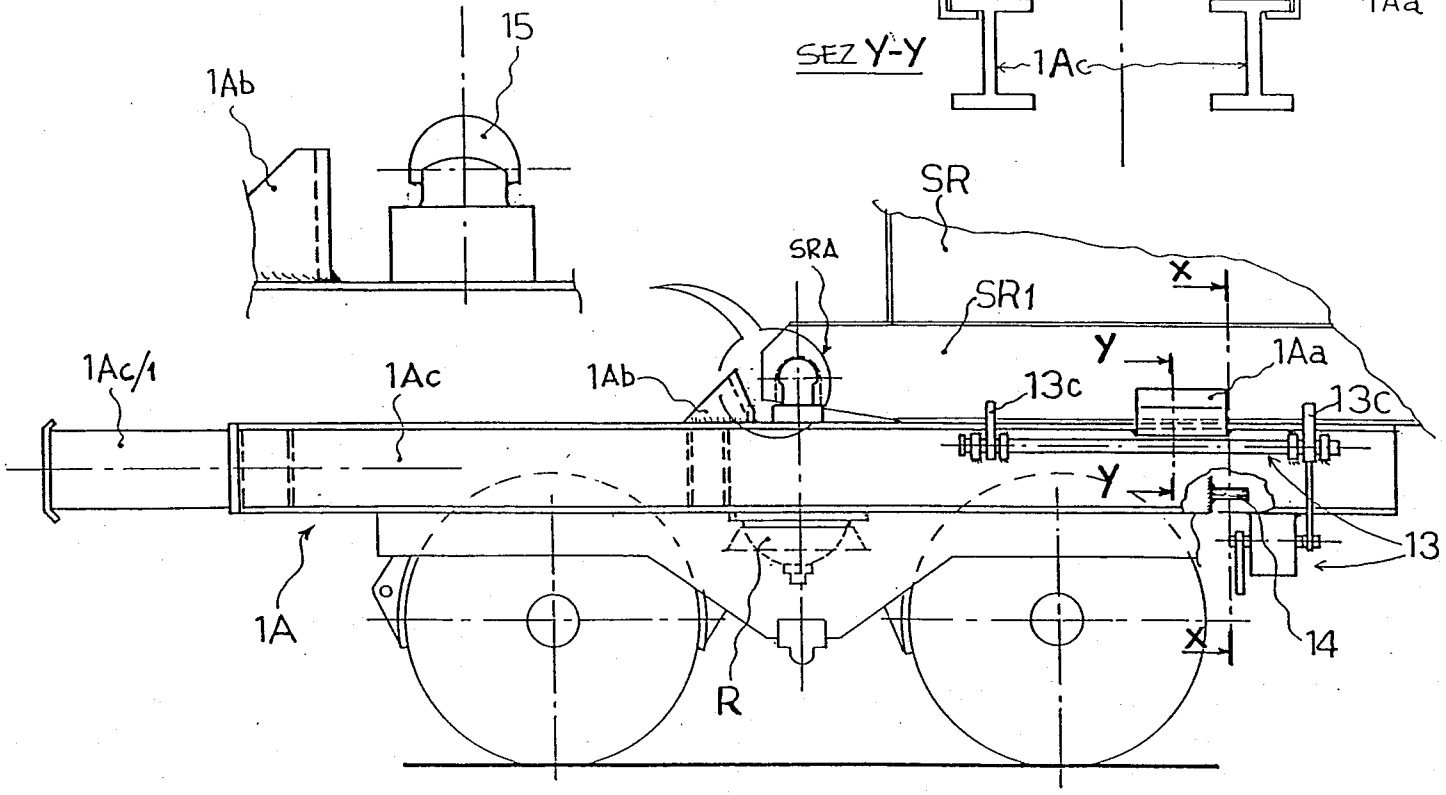
FIG. 11A
FIG. 11B

RAIL-HIGHWAY SEMI-TRAILERS

TECHNICAL FIELD

The invention relates to semi-trailers adapted to travel on rails as rail cars and on roads as highway trailers (i.e., "highway vehicles"), wherein the transformation from one mode to the other may be accomplished without the use of cranes, lifting platforms, or other similar apparatus.

More particularly, the invention relates to improvements in bimodal semi-trailers according to applicant's It. Pat. App. 2124/A86 of Oct. 23, 1986, and Eur. Pat. 87830373.4 of Oct. 22, 1987, of the present applicant, wherewith the trailer has a removable highway carriage, is adapted to travel on rails as part of a train of railroad cars, and is further adapted to travel on roads as a normal highway semi-trailer, wherewith it employs a single rail truck or a single highway carriage for these purposes, respectively, or both a rail truck and a highway carriage (if it is not desired to remove the latter.

BACKGROUND ART

In such vehicles, the installation of the rail truck is accomplished by raising one end of the chassis, and then, after having disengaged the center pin socket of the carriage, lowering the chassis and its suspension until a hemispherical center-bearing counter-element of the semi-trailer is inserted in the center pin socket of a rail truck.

This results in some difficulty in centering the center-bearing counter-element member of the semi-trailer because of the low tolerances inherent in such operations, and necessitates that the pneumatic suspension of the highway carriage have high capacity to enable the fully loaded semi-trailer to be raised by the pneumatic suspension. This occasions a costly type of suspension. The reason is the need to execute an extra excursion of about 100 millimeters in order to disengage the center pin socket from the center-bearing count-element which is affixed to the car chassis. Additionally, there is an increase in the lifting time.

In order to remove these disadvantages for semi-trailers not having a removable highway carriage, builders of bimodal (road and rail) vehicles have devised apparatus which enable rail trucks to be used without the need for raising the end of the semi-trailer which is disposed above the center pin socket of the carriage. This apparatus has disadvantages, however, that interferes with the operation of railroad-type coupling devices between the semi-trailers. Furthermore, the apparatus may be quite complex, and does not permit an elastic coupling.

Also, the semi-trailers according to the above-cited Italian patent application, whether of the type adapted to travel on rails without a highway carriage, or the type for which rail use requires that the highway carriage be held elevated, further require, in order to be connected into a normal railroad train having some normal cars, that specially adapted rail trucks be supplied (hereinafter, "shield trucks") to be used on both the rear and front parts of the attached sequence of semi-trailers, and that the rail trucks can be rapidly mounted and will not require excessive maintenance.

STATEMENT OF THE INVENTION

The principal object of the invention is to improve the operation of bimodal (that is, combined road and rail) semi-trailers having a removable highway carriage, and to provide means which are adaptable to all other types of bimodal (road and rail) vehicles known in the state of the art.

A particular object of the invention is to furnish, for the aforesaid types of bimodal cars with removable highway carriage, a novel device which enables rapid mounting of the intermediate rail trucks and of a rear "shield truck", with simple modifications.

A further important object is to furnish a "shield truck" to be mounted at the front end of a semi-trailer, which "shield truck" can be mounted using a highway-trailer coupling device already on the front of the semi-trailer.

A fourth important object is to provide means of rendering more secure the coupling between semi-trailers, which means can be effective in the event of a disabling of the main coupling device.

A fifth object of the invention is to provide means which are automatically operative for raising or lowering the chassis of the vehicle when it is being converted from highway to rail travel and vice versa.

In achieving these objects, the invention solves a number of problems, including the following:

a. The mounting of intermediate rail trucks and a rear "shield truck" on the semi-trailer, using a device which avoids lifting the rear end of the semi-trailer above the center pin socket of the rail truck but which at the same time does not interfere with the coupling systems between the semi-trailers themselves;

b. The mounting of a front "shield truck" by the same highway-trailer coupling which enables coupling between the semi-trailers; and c. The provision of a system whereby supplementary locking pins are inserted in the coupling system between the semi-trailers, by manipulation of the center-bearing counter-element bar.

BRIEF DESCRIPTION OF THE DRAWINGS

The invention will be described in detail hereinbelow with the aid of the eight plates of drawings, wherein:

FIG. 1 is a overall side view of the intermediate rail truck which is mounted on the rear end of a semi-trailer;

FIG. 2 is a top view of the two positions assumed by an "interface" to enable the intermediate rail truck to be mounted on either of the respective two ends of a chassis;

FIGS. 5A through 5E give a set of detail views of means enabling the rotation and fixation of the "interface" with respect to the rail truck;

FIG. 11 shows a "shield truck" mounted on the front end of the semi-trailer, with certain details enlarged;

FIG. 12 is a cross sectional view through Y–Y of FIG. 11, showing the profiled plates which facilitate the superposition of the front part of the semi-trailer over a rail truck;

DETAILED DESCRIPTION OF THE INVENTION

Figure 3:
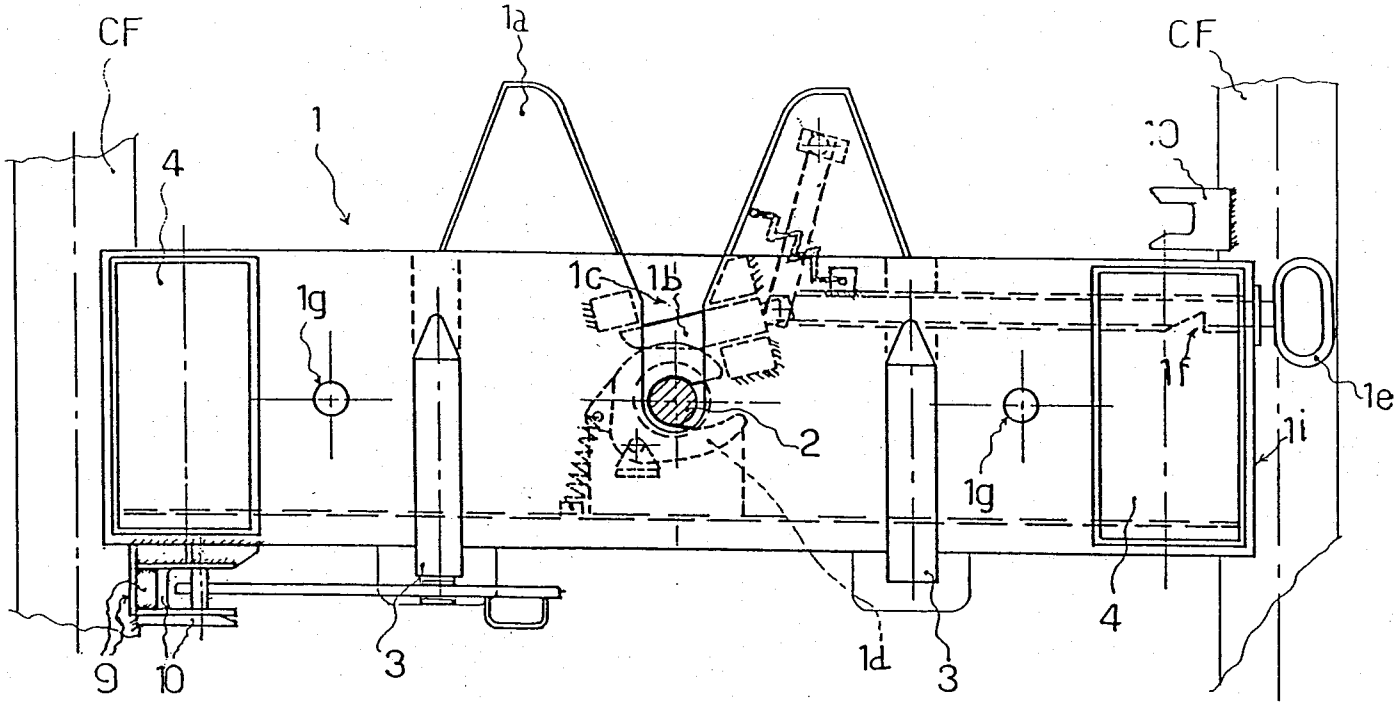
FIG. 3 is an enlarged top view detail of the "interface" of FIG. 2.
Figure 4:
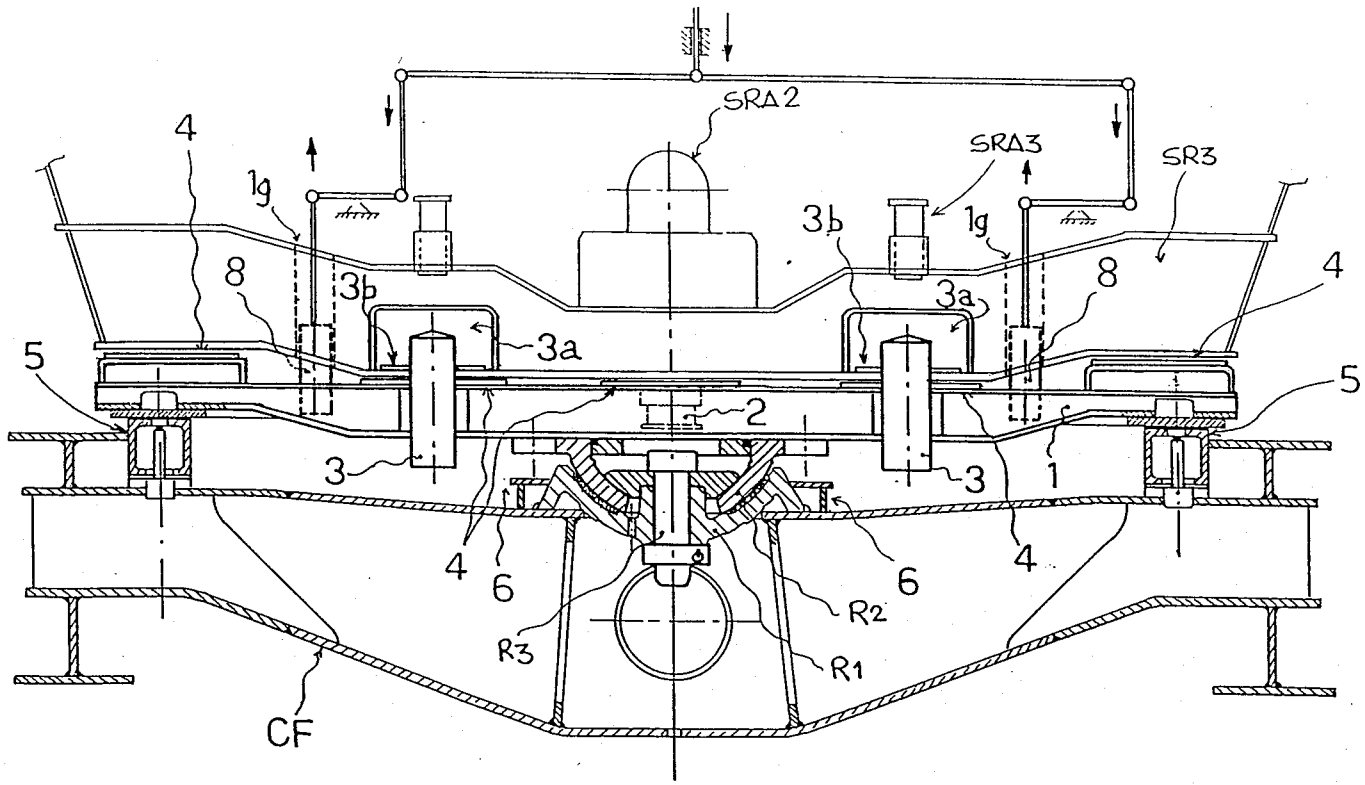
FIG. 4 is a transverse cross sectional view of the rail truck and "interface" according to the preceding Figures.

The device which enables the rail truck CF to be mounted on the transverse beam SR3 of the rear end of the semi-trailer is shown in FIGS. 1, 2, 3, and 4, and is comprised of a special hollow beam 1 (hereinafter also called the "interface"), which forms a recess (or notch) 1c delimited by guide wings 1a which are inclined toward the base of the recess, wherewith a hemispherically center-bearing counter-element R2 is affixed to the lower surface of the beam 1, which counter-element R2 is coupled to the center pin socket R1 of the rail truck by means of a bar R3 having a nut on its end. A bar 2 rigidly mounted on the transverse beam SR3 of the semi-trailer is inserted in the recess 1c. Then the "interface" 1 is fixed to the end of the semi-trailer by a hooked piece 1*d* which is held in closed position by a bolt piece 1*b;* and two fork members 3 are inserted into two respective channels 3*a* in the same hollow beam SR3. The bolt piece 1b is maneuvered with a handle 1*e* (see FIG. 3) and rests in a position whereby it blocks the hooked piece 1*d* when the notch 1f is moved into the lateral edge region of the "interface".

The "interface" can be rotated 180° around the axis of the bar R3 of the center pin socket of the rail truck, in order to enable a rail truck to be coupled normally to the semi-trailer on both ends of the trailer.

Figures 5A, 5B, 5C, 5D:
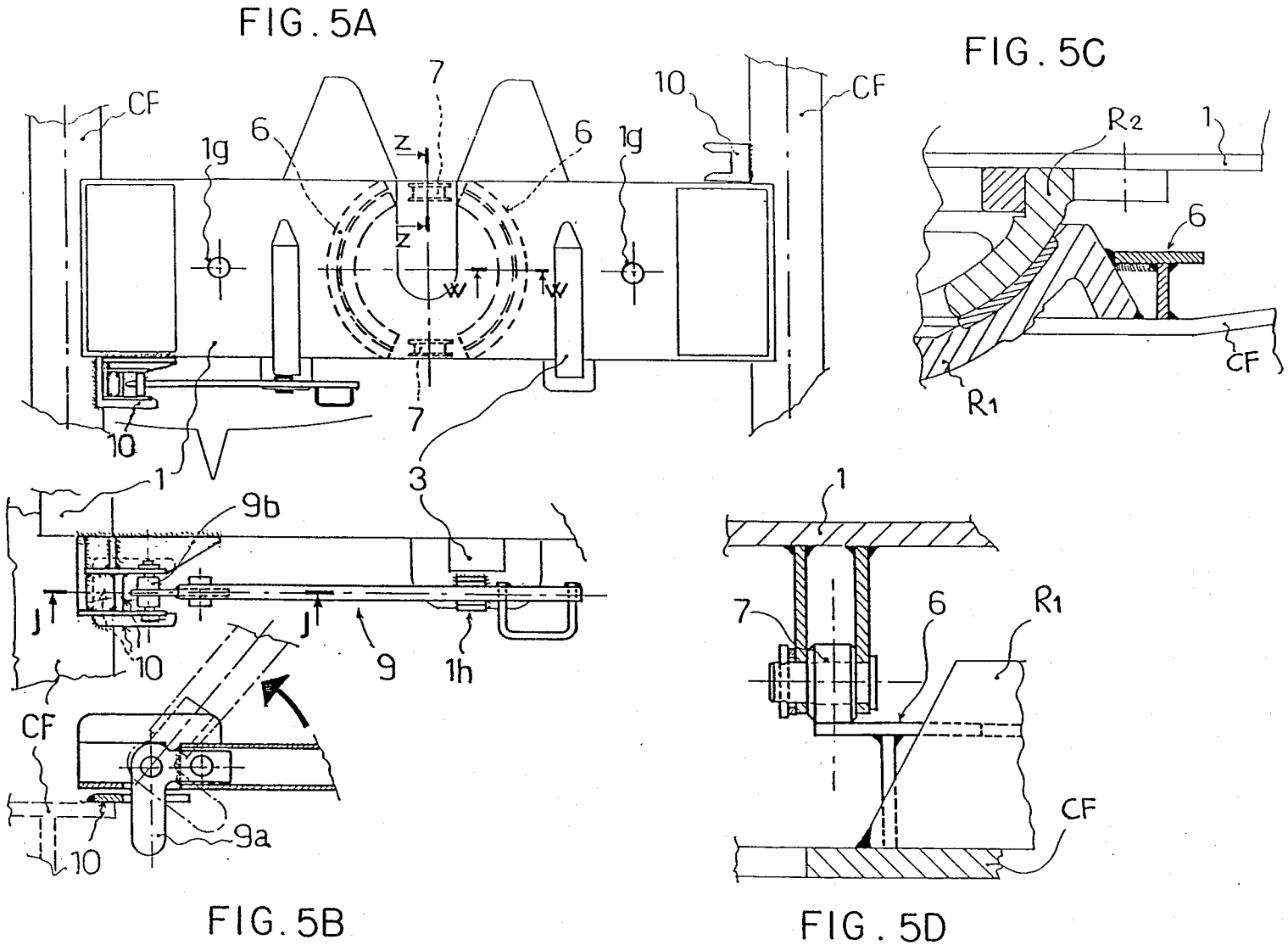

Referring also to FIGS. 5A through 5D, to achieve the coupling of the rail truck to the semi-trailer, the rod 9 is raised, which maintains the "interface" in coupling position; in particular, as shown in FIG. 5E, rod 9 is swung counterclockwise around pivot 9*b,* whereby the latch element 9*a* is freed from the fork member 10 which (member 10) is rigidly attached to the rail truck.

If the "interface" 1 is rotated by 180°, the rod 9 is swung clockwise, and the latch element 9*a* is inserted diametrically oppositely in the fork member 10. In the rest position, the rod 9 is supported in a recess 1*h.*

The fork member 3 allows the "interface" to be rotated +/−5° around the axis of the bar R3 of the center pin socket, to facilitate the coupling of the rail truck to the semi-trailer and to allow normal rotations of the rail truck during rail travel.

Rotation of the "interface" is facilitated by an annular platform 6 rigidly attached to the rail truck CF, upon which platform a plurality of wheels 7 are supported such that the attitude of the rail truck is maintained horizontal.

The plates 4 comprised of antifriction metal are intended to reduce the sliding friction experienced during the coupling of the "interface" to the semi-trailer. Also, the sliding of the fork members 3 into the channels 3*a* is facilitated by the presence of antifriction metal plates 3*b.*

Emergency back-up locking of the "interface" to the semi-trailer is provided by two pin members 8 in the hollow beam SR3 of the semi-trailer, which members 8 are moved into two holes 1g having vertical axes in the said "interface".

Figures 8, 9, 10:
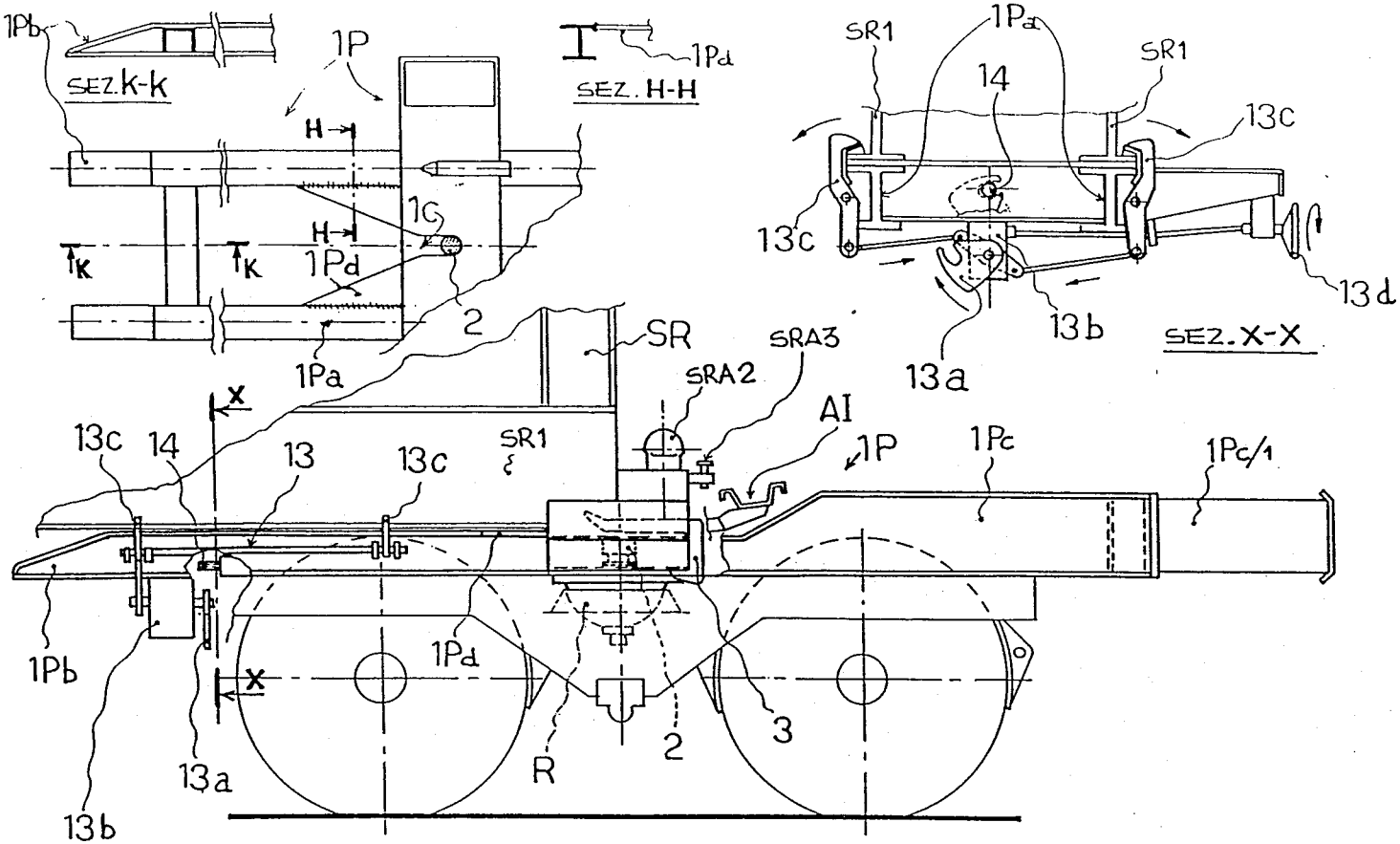
FIG. 8 shows a "shield truck" mounted on the rear end of the semi-trailer.
FIG. 9 shows details of the "interface" of the rear "shield truck"
FIG. 10 shows details of the supplementary coupling which fixes the "interface" of the "shield truck" of FIG. 8 to the longitudinal beams of a semi-trailer.

The rear "shield truck" is illustrated in FIG. 8. It is derived from the intermediate rail truck by applying a frame 1Pa to the "interface" 1, as well as (applying to "interface" 1) a frame 1Pc, to which the buffers 1pc/1 and the conventional railroad-type car coupling device are attached.

To facilitate introduction of the rear "shield truck" under the chassis of the semi-trailer, the frame 1Pa is given the shape of an inclined plane 1Pb at one end; further, the wings 1Pd are shaped to facilitate the introduction of the pin member 2 into the recess 1*c,* which recess 1c is maintained with its surface at the same level as the upper leg of the profiled beams of the frame 1Pa.

When the "shield truck" is not affixed to the semi-trailer, that is when said "shield truck" is not in service, the "interface" comprised of the hollow beam 1 and the supplementary frames 1Pa and 1Pc is maintained in a horizontal attitude by a device 13 which becomes hooked-up to it, by means of a hook 13*a* which is caused to engage a pin 14 rigidly attached to the rail truck.

The device 13 also has fork members 13*c* which provide additional locking of the frame 1Pa to the frame SR1 of the semi-trailer when the "shield truck" is coupled to the semi-trailer. To maneuver the device 13, a hand wheel 13*d* is provided, and the transmission mechanism for this hand wheel is disposed in a housing 13*b.*

The front "shield truck" is illustrated in Fig. 11. It differs from the rear "shield truck" in its system of connecting the "interface" 1A to the front end of the semi-trailer. The "interface" 1A includes:

the hollow beams 1, profile beams 1Ac on which the buffers 1Ac/1 are mounted, and the traction hook (car coupling); and on the other end, a device 13 similar to that mounted on the rear "shield truck", for supplementary fixing to the longitudinal beams SR1 of the semi-trailer and also to a pin 14 rigidly affixed to the rail truck; and further a coupling sphere 15 identical to the spherical device SRA2 mounted on the rear crossbeam of the semi-trailer and comprised of a hollow sphere SRA1 and a coupling device SRA to couple to the semi-trailer.

The front "shield truck" is coupled to the semi-trailer by connecting the hollow sphere SRA1 to that coupling sphere 15 mounted on the "shield truck" and then, with the hooks 13*c* of the device 13, locking the frame 1Ac of the "shield truck" to the longitudinal beams SR1.

The plates 1Aa are intended to position the front part of the semi-trailer over the sphere 15; this is assisted by the detent 1Ab mounted on the top of the frame of the "shield truck".

Figures 6A, 6B, 7:
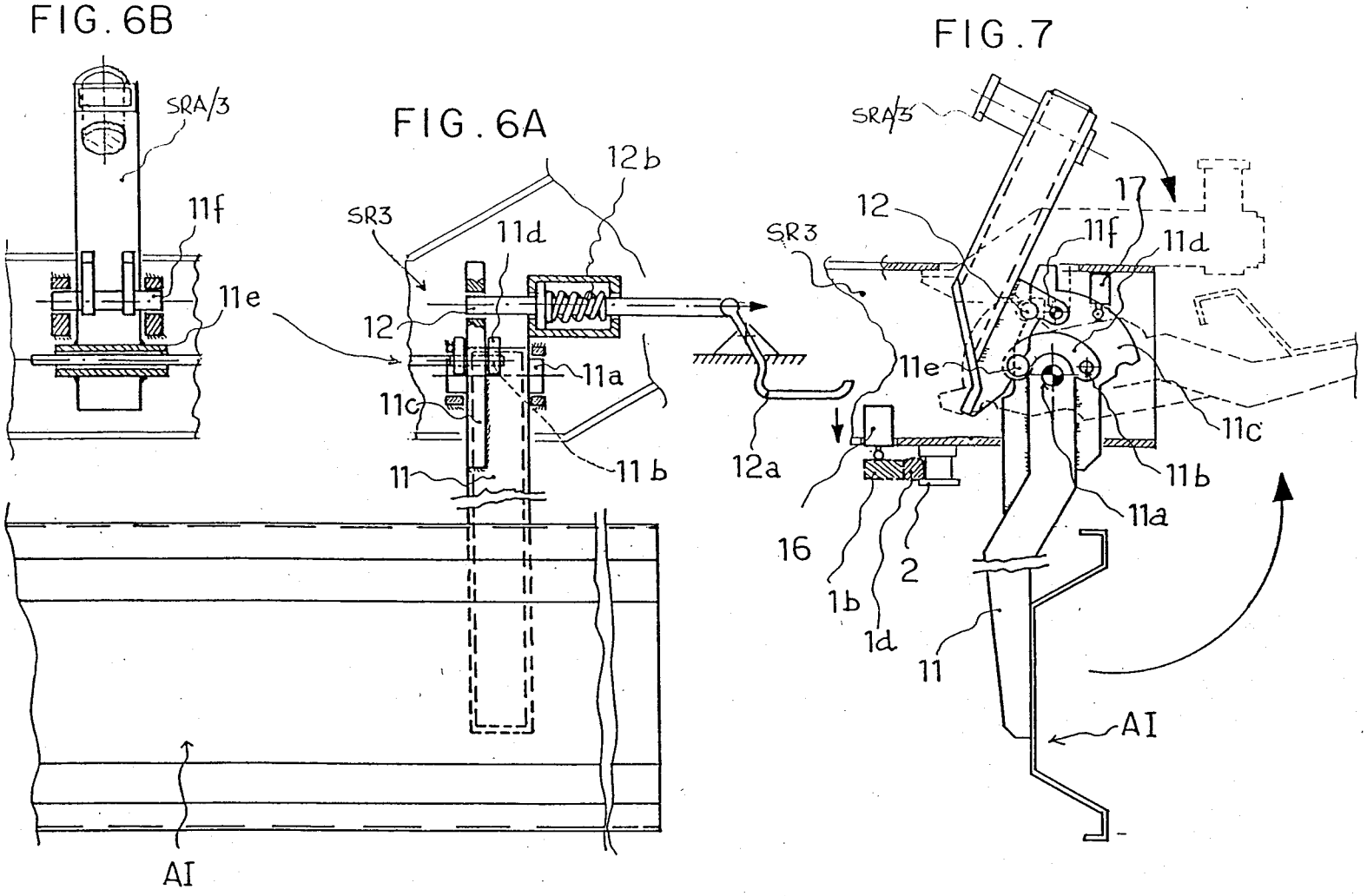
FIGS. 6A and 6B show the center-bearing counter-element bar with the levers which provide a connection of it to the locking pins of the railroad-type coupling system between semi-trailers in a train.
FIG. 7 is a cross section of FIG. 6A wherein there are indicated the mechanically actuated short stroke pneumatic control valves which are actuated by the hemispherically center-bearing counter-element bar and by the locking bolt of the hook which secures the linkage of the "interface" to the pivot of the semi-trailer.

FIGS. 6A and 6B illustrate the center-bearing counter-element bar A1 and the lever 11 which permits rotation of it. The lever 11 swings around the pivot 11a and is rigidly attached to a plate 11*c* which rotates when disengaged from the pin 12 by means of lever 12*a* which is opposed by the spring 12*b,* thereby causing, via the pin 11*e* and the connecting rod 11*d*, the rotation of the locking bar SRA3 around the pivot 11*f*, thereby locking the coupling between the semi-trailers.

The frame of the "interface" of the "shield truck" may be rotated around the pivot member R3 of the respective center pin socket, so as to enable coupling of a given "shield truck" to the semi-trailer, at either or both ends of said trailer.

Figure 13:
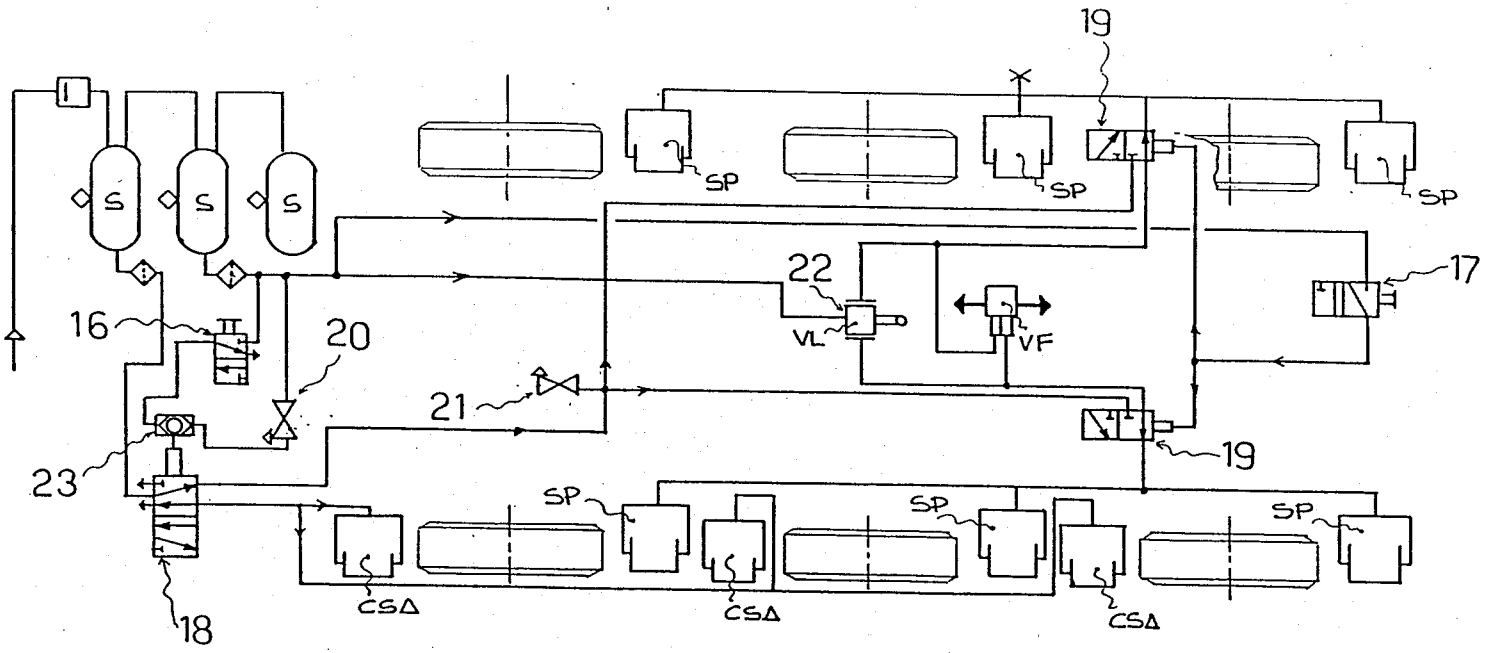
FIG. 13 is a diagram of the pneumatic system to which short stroke pneumatic control valves are connected to provide for control of the raising and lowering of the chassis of the semi-trailer.

Turning now to FIG. 13, the pneumatic system which enables the rear of the semi-trailer to be raised via the suspensions of the highway carriage is comprised of a short stroke pneumatic control valve 17 actuated as shown in FIG. 7, by the center-bearing counter-element bar A1 when the bar is swung upward (as shown in FIG. 7) to enable rail travel. This, via valve 19, causes the semi-trailer to be raised by extension of the cylinders SP of the suspension of the highway carriage. The air passes through the valve 18. The maximum lift height is determined by the short stroke pneumatic control-type relief valve 21.

The need to raise the end of the semi-trailer to a height greater than that employed by the semi-trailer when in highway travel, in carrying out the coupling maneuver whereby the rail truck CF is coupled to the semi-trailer, is due to the fact that the highway carriage is non-removable and thus must be carried when traveling by rail; accordingly the highway carriage must be raised by about 25 centimeters from rail level, which is a difficult lift to achieve with only the lifting cylinders CSA which are connected both to the semi-trailer and to the axles of the highway carriage.

After the maximum lift position of the chassis is achieved and the rail truck is inserted, the pneumatic control valve 16, actuated by the bolt associated with the hook which locks the "interface" 1 of the rail truck to the semi-trailer, in turn actuates the pneumatic control valve 18 which, in its rest state, feeds air to the pneumatic suspension cylinders SP associated with the wheels of the highway carriage, whereby air is now sent to the cylinders CSA to life the wheel axles of the highway carriage and move the axles into the interior of the boundaries prescribed for rail travel.

After the maximum lift position of the axles is achieved, the locking hooks are inserted, in conjunction with a short stroke pneumatic control valve 20, another relief valve which prevents (in the event that bolt 1*b* is accidentally withdrawn by pulling on the handle 1*e*) the valve 18 from feeding the cylinders SP of the suspensions via valves 19 when the axles of the highway carriage are elevated and are maintained in their elevated position by the mechanical hooking device; this prevention is accomplished in that valve 20 serves to block valve 18.

To enable the semi-trailer to travel, the axles of the highway carriage must be held by the respective hand-operated locking hooks, and the bolt 1*b* must be withdrawn.

These manipulations at the same time cause the suspension cylinders SP to be actuated (that is, extended to be), and the cylinders CSA to be de-actuated (i.e., retracted) via the valve 18 which is returned to the rest position. Then the center-bearing counter-element bar is lowered, whereby the leveling valve 22 is reactuated, resulting in an adjusted actuation of the cylinders SP.

Figure 14:
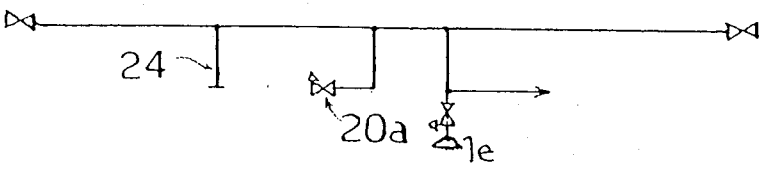
FIG. 14 shows schematically part of the pneumatic system for the brakes, which system supplies compressed air to the supplementary locking device for the coupling mechanism.

The schematic of FIG. 14 illustrates the devices which actuate the brake system for the semi-trailers by lowering the air pressure.

Braking can be brought about as indicated in FIG. 1, by breaching the tube 24 by means of the cutting member 25 (as shown in FIG. 1), or by defective engagement of the mechanical locking hook which defective engagement causes the pneumatic, control-type relief valve 20*a* to open; or by manipulating the handle 1e of the bolt 1*b*.

I claim:

1. An interface for a semi-trailer comprising:

a beam disposable between a rail truck and semi-trailer providing a recess open through one side of said beam for receiving a bar mounted on a transverse beam of the semi-trailer;

hemispherical center-bearing counter-element means rigidly attached to said beam, for coupling said beam to a center pin socket of the rail truck;

slidingly engaging elements attached to said beam for supporting said beam on sliding surfaces of the rail truck; and means connected to said beam for retaining the bar of the semi-trailer in engagement with said recess;

whereby said beam, counter-element and slidingly engaging elements are rotatable 180° about a vertical axis of said center pin.

2. The interface of claim 1, further comprised of semi-annular plates providing horizontal surfaces mounted on the rail truck; and a plurality of wheels mounted to vertically depend from said beam and roll upon said semi-annular plates during rotation of said beam about said vertical axis.

3. The interface of claim 1, further comprising:

support means extending transversely fore and aft from said beam, for supporting one end of a semi-trailer disposed on one side of the vertical axis; and a railroad coupler attached to said support means.

4. The interface of claim 3, further comprising means pivotally attached to one end of said support means, for clamping the semi-trailer to said support means while in a first operational state and for releasing the semi-trailer and maintaining one end of the support means in a horizontal position by grasping the rail truck while in a second operational state.

5. The interface of claim 1, further comprising:

support means extending transversely fore and aft from said beam;

a railroad coupler attached to said support means; and coupling means centrally disposed to project a hemispherical surface vertically above said support means, for engaging an opening in the underside of a semi-trailer.

6. The interface of claim 5, further comprising means pivotally attached to one end of said support means, for clamping the semi-trailer to said support means while in a first operational state and for releasing the semi-trailer and maintaining one end of the support means in a horizontal position by grasping the rail truck while in a second operational set.

7. A bimodal conveyance, comprising:

a horizontally disposed cross beam having recess means open along one vertical side of said beam for receiving a member vertically depending from beneath a semi-trailer disposed above said cross beam;

guide means extending from said cross beam, for guiding the vertically depending member into said recess;

means for securing the vertically depending means within said recess; and hemispherical center-bearing counter-element means symmetrically affixed to an underside of said cross beam to mate with a conforming center-bearing element mounted upon a rail truck disposed beneath said cross beam, for enabling said beam to rotate 180° about a vertical axis extending through said recess and hemispherical center-bearing counter-element means.

8. The conveyance of claim 7, further comprising:

forked means for joining said cross beam to one end of the semi-trailer; and latching means rotatingly coupled to said beam, for holding said forked means in a position joining said cross beam to the semi-trailer while said latching means engages a second element attached to the rail truck.

9. The conveyance of claim 7, further comprising bearing means disposed beneath said cross beam and spaced-apart from said hemispherical center-bearing counter-element means, for rolling along a horizontal rim of the rail truck while said cross beam rotates about said vertical axis.

10. The conveyance of claim 7, further comprising pneumatic means operated by said securing means, for raising axles of a highway carriage attached to the semi-trailer.

11. The conveyance of claim 7, further comprising a first semi-trailer having a centrally disposed, vertically extending member, said semi-trailer being mounted upon said cross beam with said vertically extending member positioned within said recess means.

12. The conveyance of claim 11, wherein said first semi-trailer further comprises:

a transverse beam; and locking means rotatably supported by said transverse beam and having a plurality off vertically extending means spaced-apart from said vertical axis, for engaging an underside of a second semi-trailer longitudinally aligned with said first semi-trailer.

13. The conveyance of claim 12, further comprising:

said transverse beam containing a plurality of spaced-apart holes open to an underside of said transverse beam, said plurality of holes being spaced apart from said vertical axis;

a plurality of pins with each of said pins being disposed within a different one of said holes; and means for causing said pins to vertically reciprocate within said holes and to extend beyond said underside and into corresponding holes within said cross beam.

14. The conveyance of claim 12, wherein said first semi-trailer further comprises coupling means centrally disposed along said transverse beam, for engaging an opening in a underside of a second semi-trailer longitudinally aligned with said first semi-trailer.

15. The conveyance of claim 14, wherein said first semi-trailer further comprises a locking mechanism rotatably mounted upon said transverse beam and having a plurality of vertically extending means spaced apart from said vertical axis, for engaging said underside of the second semi-trailer.

16. The conveyance of claim 7, further comprising:

support means extending transversely fore and aft from said cross beam, for supporting one end of a semi-trailer disposed on one side of the vertical axis; and a railroad coupler attached to said support means.

17. The conveyance of claim 16, further comprising means pivotally attached to one end of said support means, for clamping the semi-trailer to said support means while in a first operational state and for releasing the semi-trailer and maintaining said one end of the support means in a horizontal position by grasping the rail truck while in a second operational state.

18. The conveyance of claim 7, further comprising:

support means extending transversely fore and aft from said cross beam;

a railroad coupler attached to said support means; and coupling means centrally disposed to project a hemispherical surface vertically above said support means, for engaging an opening in the underside of a semi-trailer.

19. The conveyance of claim 18, further comprising means pivotally attached to one end of said support means, for clamping the semi-trailer to said support means while in a first operation state and for releasing the semi-trailer and maintaining said one end of the support means in a horizontal position by grasping the rail truck while in a second operational state.

20. A bimodal conveyance, comprising:

a horizontally disposed cross beam having means centrally disposed along an upper portion of said cross beam for mating with a conforming member disposed beneath a semi-trailer placed above said cross beam;

said cross beam including means for restricting horizontal movement of a semi-trailer engaged by said mating means;

hemispherical center-bearing counter-element means symmetrically affixed to an underside of said cross beam to mate with a conforming center-bearing element mounted upon a rail truck disposed beneath said cross beam, for enabling said cross beam to rotate 180° about a vertical axis extending through said mating means and hemispherical center-bearing counter-element means;

support means extending transversely fore and aft from said cross beam, for supporting one end of a semi-trailer disposed on one side of the vertical axis;

a railroad coupler attached to said support means;

means pivotally attached to one end of said support means, for clamping the semi-trailer to said support means while in a first operational state and for releasing the semi-trailer and maintaining said one end of the support means in a horizontal position by grasping the rail truck while in a second operational state; and means attached to one of said cross beam and said support means for guiding placement of the semi-trailer relative to said mating means.

* * * * *